US005207725A

United States Patent [19]

Pinkerton

[11] Patent Number: 5,207,725

[45] Date of Patent: May 4, 1993

[54] SOAP HOLDER

[76] Inventor: Linda L. Pinkerton, 7110 Winchester Rd., Ft. Wayne, Ind. 46819

[21] Appl. No.: 758,004

[22] Filed: Sep. 12, 1991

Related U.S. Application Data

[63] Continuation-in-part of Ser. No. 664,859, Mar. 5, 1991, abandoned.

[51] Int. Cl.[5] ..... B65D 30/06; B65D 33/14; B65D 33/16

[52] U.S. Cl. ..... 383/24; 24/30.5 L; 383/13; 383/71; 383/102; 383/117

[58] Field of Search ..... 383/102, 103, 117, 74, 383/76, 70, 71, 22, 24, 13; 24/30.5 R, 30.5 L

[56] References Cited

U.S. PATENT DOCUMENTS

| | | | |
|---|---|---|---|
| 835,673 | 11/1906 | Fross | 383/75 |
| 1,795,417 | 3/1931 | Allen | 383/76 |
| 2,064,594 | 12/1936 | Dickey | 383/103 |
| 2,132,734 | 10/1938 | Hart et al. | 383/102 |
| 2,163,324 | 6/1939 | Reinhold | 383/103 |
| 2,390,423 | 12/1945 | Carter | 383/117 |
| 2,598,334 | 5/1952 | Ahlburg | 383/76 |
| 2,602,482 | 7/1952 | Lyon | 383/102 |
| 2,678,672 | 5/1954 | Spilman | 383/76 |
| 3,309,742 | 3/1967 | Chin | 24/30.5 L |
| 4,098,405 | 7/1978 | Botvin | 383/117 |

FOREIGN PATENT DOCUMENTS

| | | | |
|---|---|---|---|
| 240803 | 5/1960 | Australia | 383/71 |
| 29256 | 12/1956 | Fed. Rep. of Germany | 383/24 |
| 1251372 | 12/1960 | France | 24/30.5 L |
| 75401 | 5/1961 | France | 383/22 |
| 1386309 | 12/1964 | France | 383/71 |
| 559682 | 3/1957 | Italy | 383/22 |

*Primary Examiner*—Stephen P. Garbe

[57] ABSTRACT

The present invention is composed of a sack for a bar of soap made from soft polyester netting tube, one end being closed or sealed, the opposite end being open and adapted to be closed to retain the bar of soap therein. The open end is adapted to be closed and a loop of synthetic material is attachable thereto. Encompassing the loop is a slidable bead to secure the loop to the arm of the user or to any other object within the confine of the bath or shower. A second embodiment of the closure as part of the present invention uses a disc with an annular groove which encompasses the aforesaid closure adaptor for the netting tube.

6 Claims, 2 Drawing Sheets

SOAP HOLDER

This application is a continuation-in-part of U.S. application Ser. No. 07/664,859 filed 5 March 1991, hereby abandoned upon this filing.

FIELD OF INVENTION

The present invention is in the general field of personal toiletries. More specifically, it is in the field of soap holding and dispensing devices.

BACKGROUND OF THE INVENTION

Toilet soap in bar form is by far the most common type of soap employed in households, hotels, motels, etc. The use of soap in this form has certain longstanding disadvantages. It is not possible for a bar of soap to be completely consumed because it eventually becomes so small as to be ineffectual for further use in the normal way. The majority of persons discard the bar when it becomes this small.

Another characteristic of bar soap is its tendency to soften when kept in conventional soap trays or the like between periods of use. This softening reduces a bar of soap to a mushy consistency on its underside even when it is supported in such a way as to permit the drainage of moisture from the bar and the circulation of air therearound.

Another problem with bar soap is the slippery surface when wet which makes the bar difficult to hold. As a result, wet soap is often dropped. Sometimes the bar, when dropped, will break or split into two or more pieces. When a person is handicapped in a way to make it difficult for him to retrieve a dropped bar of soap, the dropping becomes a serious problem instead of a mere annoyance. In some cases where a person is seriously afflicted with arthritis in his hands, it is difficult to grip a bar of soap even before it becomes slippery, and virtually impossible to hold onto the bar after it gets wet. A blind person dropping a bar of soap in a shower will obviously have a greater problem than a person with good eyesight.

One attempt to overcome the above disadvantages was to mold a bar or ball of soap on a loop of synthetic material, "soap on a rope", which would be resistant to the moisture present when the soap was not being used. The loop could be placed on a handle of the shower or tub fixture and used with a wash cloth in a conventional manner. When the ball or bar became too small for further use the remaining soap and loop were discarded.

The most recently known means for overcoming the foregoing disadvantages can be seen in U.S. Pat. No. 4,480,939. Therein is disclosed a sack formed from synthetic netting material of a size to receive the common size of bar soap. The sack is not closed at its open end by reason of two upwardly extending flaps with means at their terminus to receive a hook element which extends outwardly from a base attached to a support surface. The texture of the netting permits easy holding of the soap even when wet. The texture of the netting is no more abrasive than the texture of a wash cloth with which use can be dispensed. A sighted person can easily place the sack on the hook. The sight impaired person can do so only by feeling for the hook in the course of which seeking the sack may be dropped. If the sack is dropped, the soap bar may slide out of the sack and this problem is compounded.

SUMMARY OF THE PRESENT INVENTION

The present invention is composed of a sack for a bar of soap made from soft polyester netting tube, one end being closed or sealed, the opposite end being open and adapted to be closed to retain the bar of soap therein. The open end is adapted to be closed and a loop of synthetic material is attachable thereto. Encompassing the loop is a slidable bead to secure the loop to the arm of the user or to any other object within the confine of the bath or shower. A second embodiment of the closure as part of the present invention uses a disc with an annular groove which encompasses the aforesaid closure adaptor for the netting tube.

BRIEF DESCRIPTION OF THE DRAWINGS

The invention in its embodiments is shown in the accompanying drawings by way of illustration.

DETAILED DESCRIPTION OF THE INVENTION

Figure 1:
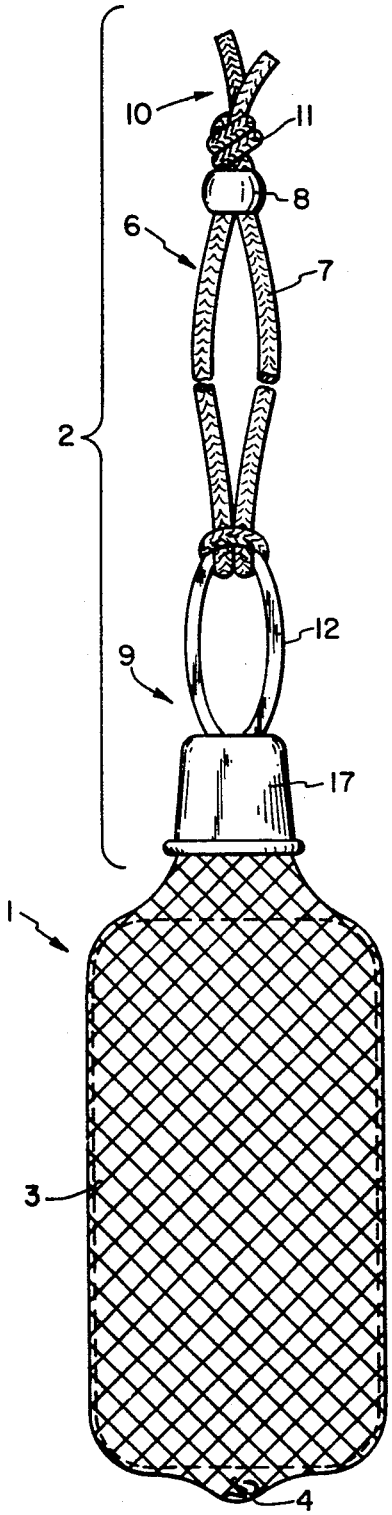
FIG. 1 is a top plan view of one embodiment of the invention showing a bar of soap therein, the bottom plan view being substantially identical.
Figure 3:
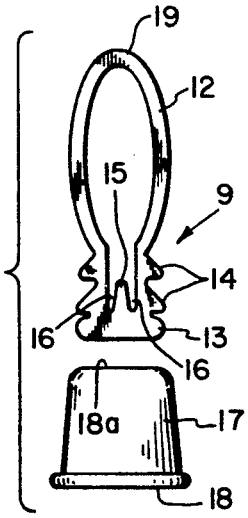
FIG. 3 is a top plan exploded view of the closure element seen in FIGS. 1-3.
Figure 2:
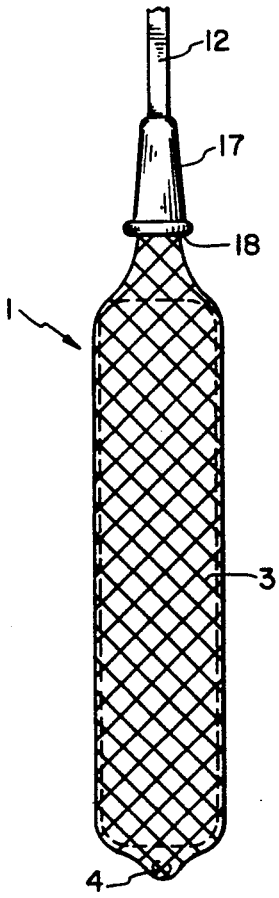
FIG. 2 is an elevation view of one side of the invention seen in FIG. 1 the opposing side being identical.
Figure 6:
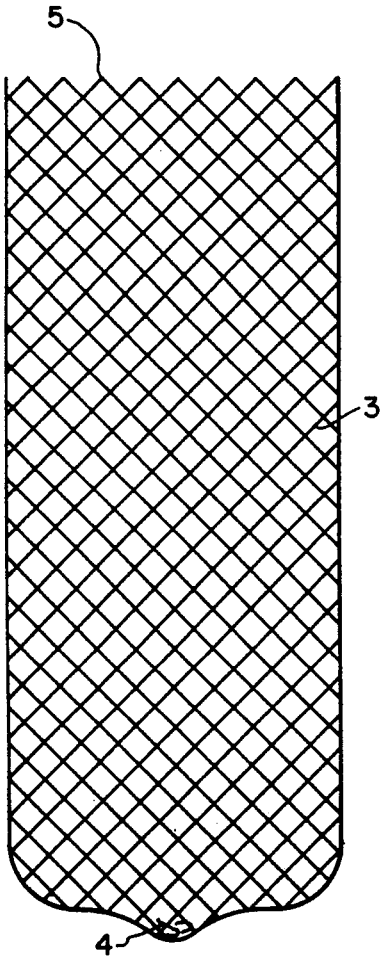
FIG. 6 is a top plan view of the soap retaining element seen in FIG. 1, the bottom plan view being identical.

Referring to FIGS. 1-3, the invention comprises a soap retaining element 1 and a suspending element 2. The soap retaining element 1 is formed from a tube 3 of a soft textured non-abrasive thermoplastic netting. The netting tube is cut to a predetermined length and one end 4 of the tube is closed by adhesive or heat sealing thereof. As seen in FIG. 6 the end 5 of the tube netting opposite the closed end is left unfinished for purposes as will be described. The suspending element comprises a cord 6 formed into a two strand loop 7, one end of which loop 7 is secured to the closure element 9, the other end 10 being secured by a knot 11. A slideable bead 8 is positioned on loop 7 before knot 11 is formed. Bead 8 being slidable along loop 7 allows the invention to be securely suspended from the user's wrist or any fixture within a bathing enclosure to insure that element 1 is always within the reach and grasp of the user and will not fall into the bottom of the bathing enclosure.

Figure 4:
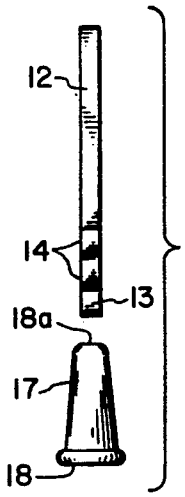
FIG. 4 is an elevation view of one side of FIG. 3, the opposite side being identical.
Figure 5:
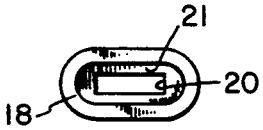
FIG. 5 is an elevation view of the base end of FIG. 3 held by the loop element of FIG. 3.

As seen in FIGS. 3-5, the closure element 9 formed from a resilient thermoplastic comprises an elongated loop element 12, a base element 13, opposing serrated edges 14, a tongue 15 extending from base 13 into the interior of loop element 12 thereby creating a slot 16 on each side of tongue 15 and sleeve 17 which slidably receives and retains edges 14 of loop element 12 after said loop element 12 is inserted into the end 18 of sleeve 17. The other end 18*a* of sleeve 17 has a narrow opening 20 thus providing a surface 21 against which the uppermost edge 14 is in contact to prevent closure element 9 from being pulled out of sleeve 17 through opening 20. Prior to inserting loop element 12 into sleeve 17 through end 18, the end 5 of tube 3 in FIG. 6 is folded together and placed within the interior of loop element 12 over tongue 15 and into slots 16. Loop 7 is then secured to the upper closed end 19 of loop element 12.

Figure 7:
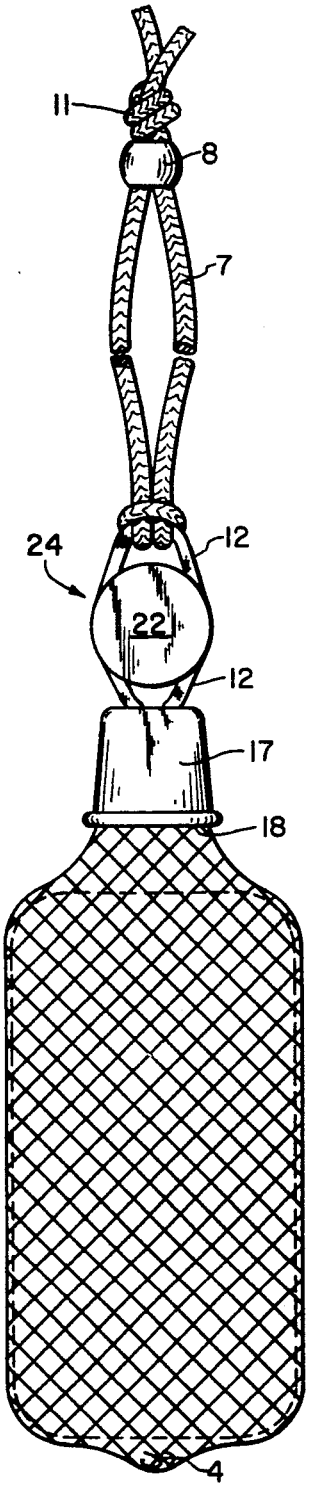
FIG. 7 is a partial top plan view of the second embodiment of the invention seen in FIG. 1, the bottom plan view being substantially identical.
Figure 8:
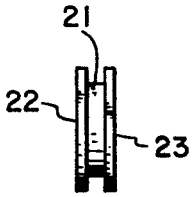
FIG. 8 is an elevation view of the disc seen in FIG. 7, the view from all sides being identical.
Figure 9:
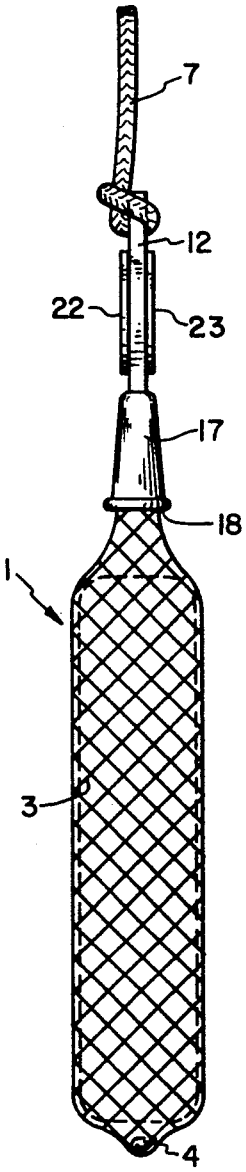
FIG. 9 is an elevation view of one side of the embodiment seen in FIG. 7, the view of the opposite side being identical.

Referring to FIGS. 7–9, it will be evident that the principal difference between FIGS. 1 and 7 is the insertion of a disc 24 into loop element 12. As is seen in FIG. 7, the insertion of disc 24 will expand edges 14 into increased contact with sleeve 17. FIG. 8 shows circular disc 24 to carry an annular groove 21 into which groove loop element 12 can be inserted as shown in FIG. 9. It will be readily recognized that the flat surfaces 22 and 23 of disc 24 can be used to display logos of sports teams, advertising of products, identification of various types events as promotional aids.

As the thermoplastic science advances, changes in the composition of the components herein described for the present invention and the shapes thereof may depart from that which is presently shown and described. Such variations are considered to come within the scope of the appended claims.

What is claimed is:

1. A soap holder for holding and dispensing bathing soap, which can be temporarily secured to an outwardly extending element, comprising:

a sack element of a size to receive and hold at least a bar of bathing soap, said sack element being formed from a tubular segment of a soft, non-abrasive thermoplastic netting having an open end and a closed end;

means for closing and securing said open end of said tubular segment, said closing and securing means including a loop element;

a suspending element having a first end attached to said loop element and a second end defining a suspending loop having an opening within which the outwardly extending element may be received; and bead means slidable along said suspending loop for varying the size of the opening of said suspending loop, whereby the soap holder may be temporarily secured to the outwardly extending element.

2. The soap holder of claim 1 wherein said means for closing and securing said open end of said tubular segment comprises a resilient elongated loop element having sides with at least a pair of opposed serrated edges, said sides terminating in a base element having an inwardly extending tongue element forming a slot on each side thereof, said open end of said tubular segment being received in said slots and impaled on said tongue, said closing and securing means further comprising a sleeve element which slidably receives and retains said loop element sides therein, said suspending loop being attached to said elongated loop element.

3. The soap holder of claim 2 and further comprising a disc having an annular groove between top and bottom surfaces of said disc, said disc being inserted into said elongated loop element to press said side serrated edges thereof into secure contact with said sleeve element.

4. A soap holder for holding and dispensing bathing soap, which can be temporarily secured to an outwardly extending element, comprising:

a sack element of a size to receive and hold at least a bar of bathing soap, said sack element being formed from a tubular segment of a soft, non-abrasive thermoplastic netting having an open end and a closed end;

means for closing and securing said open end of said tubular segment, said closing and securing means including an elongated loop element having sides with at least a pair of opposed serrated edges, said sides terminating in a base element having an inwardly extending tongue element forming a slot on each side thereof, said open end of said tubular segment being received in said slots and impaled on said tongue, said closing and securing means further including a sleeve element which slidably receives and retains said loop element sides therein;

a suspending element having a first end attached to said loop element and a second end defining a suspending loop having an opening within which the outwardly extending element may be received; and bead means slidable along said suspending loop for varying the size of the opening of said suspending loop, whereby the soap holder may be temporarily secured to the outwardly extending element.

5. The said holder of claim 4 and further comprising a disc having an annular groove between top and bottom surfaces of said disc, said disc being inserted into said elongated loop element to press said side serrated edges thereof into secure contact with said sleeve element.

6. A soap holder for holding and dispensing bathing soap, which can be temporarily secured to an outwardly extending element, comprising:

a sack element of a size to receive and hold at least a bar of bathing soap, said neck element being formed from a tubular segment of a soft, non-abrasive thermoplastic netting having an open end and a closed end;

means for closing and securing said open end of said tubular segment, said closing and securing means including an elongated loop element having sides with at least a pair of opposed serrated edges, said sides terminating in a base element having an inwardly extending tongue element forming a slot on each side thereof, said open end of said tubular segment being received in said slots and impaled on said tongue, said closing and securing means further including a sleeve element which slidably receives and retains said loop element sides therein;

a suspending element having a first end attached to said loop element and a second end defining a suspending loop having an opening within which the outwardly extending element may be received; and bead means slidable along said suspending loop for varying the size of the opening of said suspending loop; and a disc having an annular groove between top and bottom surfaces of said disc, said disc being inserted into said elongated loop element to press said side serrated edges thereof into secure contact with said sleeve element.

* * * * *